US005669180A

United States Patent [19]

Maier

[11] Patent Number: 5,669,180

[45] Date of Patent: Sep. 23, 1997

[54] WINDOW BALANCE BRAKE SHOE AND PIVOT ASSEMBLY

[76] Inventor: Robert G. Maier, 40 Prescott, Hudson, Ohio 44236

[21] Appl. No.: 654,597

[22] Filed: May 29, 1996

[51] Int. Cl.[6] ..... E05D 15/22

[52] U.S. Cl. ..... 49/181; 49/193; 49/176

[58] Field of Search ..... 49/176, 181, 193, 49/445, 446, 453; 16/193, 342; 403/326, 324

[56] References Cited

U.S. PATENT DOCUMENTS

| | | | |
|---|---|---|---|
| 4,262,449 | 4/1981 | Riegelman et al. | 49/446 |
| 4,610,108 | 9/1986 | Marshik . | |
| 4,850,735 | 7/1989 | Hansen et al. | 403/329 |
| 5,069,001 | 12/1991 | Makarowski | 49/176 |
| 5,139,291 | 8/1992 | Schultz . | |
| 5,237,775 | 8/1993 | Hardy . | |
| 5,243,783 | 9/1993 | Schmidt et al. . | |
| 5,251,401 | 10/1993 | Prete et al. | 49/181 |
| 5,301,467 | 4/1994 | Schmidt et al. | 49/181 |
| 5,371,971 | 12/1994 | Prete . | |

*Primary Examiner*—Joanne Silbermann
*Assistant Examiner*—Curtis Cohen
*Attorney, Agent, or Firm*—Pearne, Gordon, McCoy & Granger LLP

[57] ABSTRACT

A brake is disposed in a window frame. The brake includes a cam that causes the brake to engage the frame to resist movement of the brake. The cam is operated by a pivot assembly mounted in a sash of the window. A body of the pivot assembly slides into a notch in the sash and is retained by a detent. The pivot assembly includes an eccentric pivot bar that is received in an eccentric passage of the cam. The pivot bar engages a stop in the body and has a detent that engages a lip in the body.

14 Claims, 3 Drawing Sheets

WINDOW BALANCE BRAKE SHOE AND PIVOT ASSEMBLY

BACKGROUND OF THE INVENTION

1. Field of the Invention

This invention relates generally to the field of windows and specifically to a brake shoe and pivot assembly for a window counterbalance.

2. Description of the Related Art

Double hung windows are provided with counterbalances for maintaining a sash in an elevated position. Springs or weights connected to the sash to act as the counterbalance. Many window sashes are adapted for tilting inwardly for cleaning. The sash tilts on a pivot assembly at the bottom of the sash. Spring operated tilt latches at the top of the sash retain the sash in the vertical position and are released for pivoting of the sash.

The pivot assembly commonly is associated with a brake that firmly maintains the sash in place when the sash is tilted. Examples of such pivots and brakes are shown in U.S. Pat. Nos. 4,610,108 to Marshik, 5,069,001 to Makarowski, 5,139,291 to Schultz, 5,237,775 to Hardy and 5,243,783 to Schmidt et al, all incorporated herein by reference. The pivot assembly is typically fastened to the sash with screws or otherwise, as shown in U.S. Pat. Nos. 5,251,401 and 5,371,971 to Prete.

SUMMARY OF THE INVENTION

The present invention provides a pivot assembly for a window assembly having a window sash with a notch defining a pair of opposed tracks and having a brake assembly slidably disposed in a frame of the window assembly. The pivot assembly includes a rigid body and a pivot bar projecting from the body. The pivot bar has an end adapted for being received in the brake assembly. A flange extends from the body and has walls spaced from walls of the body so as to define a pair of opposed channels. The assembly is slidable into the window sash and the channels are adapted for receiving the opposed tracks of the window sash therein.

The flange and body define a generally I-shaped cross section. The flange walls are flexible for accommodating deformations and thickness variations of edges of the track received in the channels. The walls of the body are sloped for accommodating deformations and thickness variations of edges of the track received in the channels. The body is generally parallelepipedic and includes a longitudinal bore receiving the pivot bar therein, wherein the bore is stepped so as to define a lip and a stop, the pivot bar is provided with a detent engaging the lip, and an end of the pivot bar engages against the stop to limit longitudinal movement of the pivot bar and retain the pivot bar in the body.

A detent projects from the body and is adapted for engaging a wall of the window sash for retaining the pivot assembly therein. The body is generally parallelepipedic and further comprises a longitudinal bore receiving the pivot bar therein. The bore is stepped so as to define a lip and the pivot bar is provided with a detent engaging the lip to limit longitudinal movement of the pivot bar and retain the pivot bar in the body. The bore is stepped so as to define a stop and an end of the pivot bar engages against the stop to limit longitudinal movement of the pivot bar and retain the pivot bar in the body. A flange projects from the pivot bar and is adapted for engaging in the brake assembly. The flange is spaced from an end of the pivot bar to define a nose.

The invention also provides a pivot and brake assembly for a window assembly. The invention includes a brake assembly having a housing slidably disposed in a frame of the window assembly; a brake movable to engage the frame so as to resist movement of the housing in the frame; a cam disposed in the housing and rotatable for moving the brake.

The pivot and brake assembly also includes a pivot assembly having a rigid body; a pivot bar projecting from the body and having an end received in the cam so that pivoting of the pivot bar rotates the cam; and a flange extending from the body and having walls spaced from walls of the body for defining a pair of opposed channels, the assembly being slidable into a notched window sash of the window assembly and the channels being adapted for receiving opposed tracks of the window sash therein.

The cam includes a central passage in which the pivot bar is received, the bore having a lip therein, and the pivot bar includes a flange projecting from the pivot bar and engaging the lip to limit longitudinal movement of the pivot bar and retain the pivot bar in the cam. The flange is spaced from an end of the pivot bar to define a nose and the cam is provided with a back wall for engaging the nose to limit longitudinal movement of the pivot bar and retain the pivot bar in the cam. The pivot bar is eccentric and the cam includes an eccentric passage in which the pivot bar is received, the bar and passage mating so as to limit rotation of the bar relative to the cam.

The invention also provides a window assembly including a frame having two spaced, opposing, generally parallel slide channels. A sash has two spaced, generally parallel stiles and spaced, generally parallel header and footer rails assembled to form a generally rectangular shape. Each of said stiles is adapted for sliding along a corresponding one of the slide channels, and said footer rail has a hollow construction and a notch at each end thereof, each notch defining a pair of opposed, generally parallel tracks. A pair of brake assemblies as described above are slidably disposed in the respective slide channels. The brake is movable to engage the slide channel so as to resist movement of the housing in the slide channel. A pair of pivot assemblies as described above are slidable into the notch of the sash and the channels receiving opposed tracks of the respective window sash notch therein. A counterbalance is disposed in each of the slide channels and attached to the corresponding brake assembly.

DESCRIPTION OF THE PREFERRED EMBODIMENTS

Figure 1:
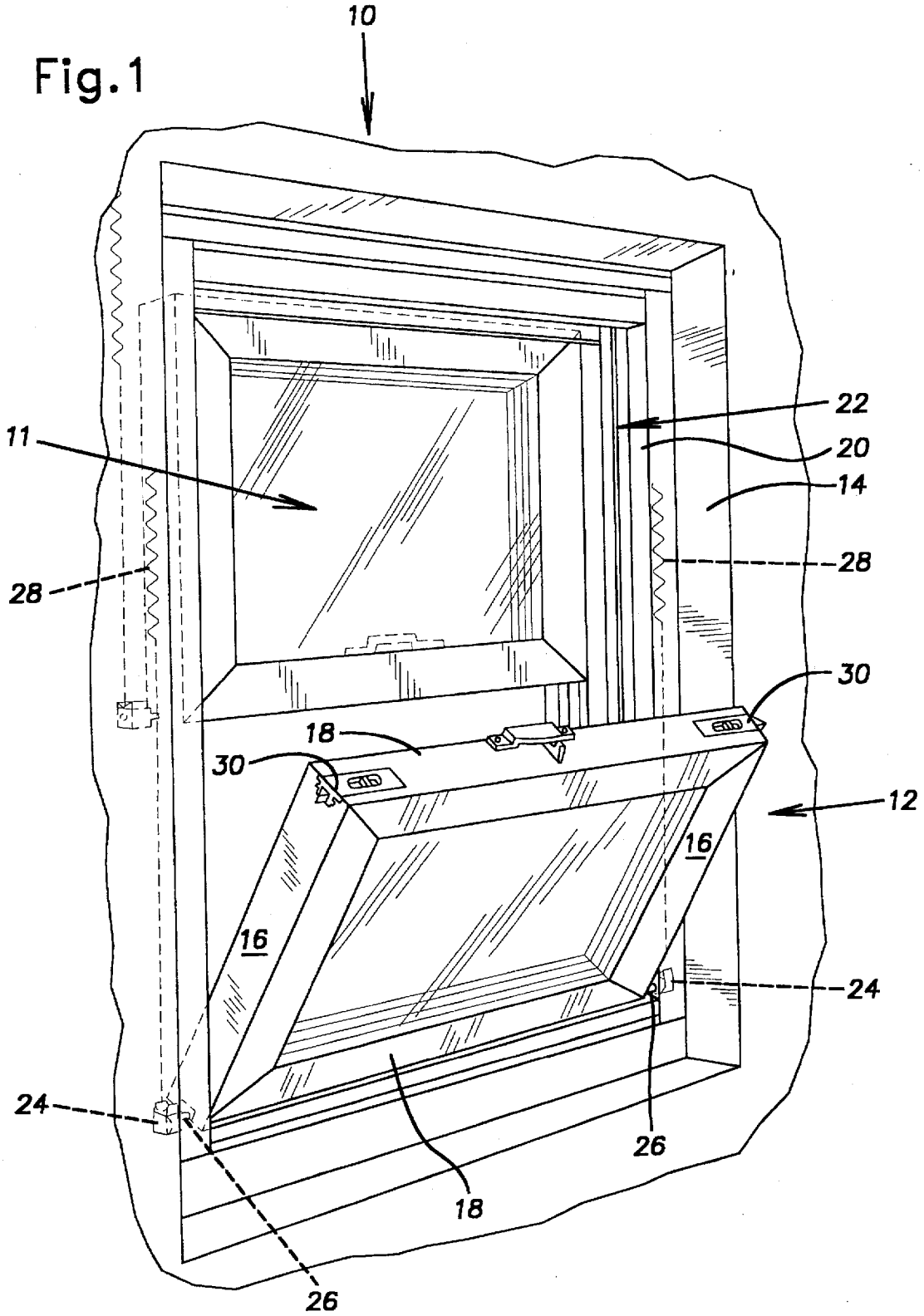
FIG. 1 shows a perspective view of a double hung window assembly.

Referring to FIG. 1, a double hung window assembly 10 includes an upper sash 11 and a lower sash 12 that are slidable in a window frame 14. The lower sash 12, for example, includes vertically disposed stiles 16 and horizontally disposed rails 18 including an upper header rail and a lower footer rail. The window frame includes vertical jambs 20 defining opposed vertical slide channels 22 or tracks. Brake assemblies 24 are slidable in respective slide channels 22. Lower corners of the sash 12 are provided with pivot assemblies 26 that are associated with respective brake assemblies 24 to define pivot and brake assemblies. The brake assemblies 24 are supported by respective counterbalances, such as balance springs 28 disposed in the slide channels 22. Tilt latches 30 are disposed in upper corners of the sash 12 for releasably retaining the upper end of the sash in the slide channels 22.

Referring to FIGS. 2 through 5, the pivot assembly 26 includes a housing 32 and a pivot bar 34 located therein. The housing 32 includes a body 36 having a longitudinal bore 38. The bore 38 shown is generally rectangular, but other shapes are suitable as is apparent from the following description of the pivot bar 34. The bore 38 is stepped, that is, different parts of the bore have different cross-sectional dimensions and shapes. One end of the bore defines a mouth 40 slightly wider than the pivot bar 34 to facilitate installation and allow slight flexing thereof. A main part 42 of the bore is sized to snugly retain the pivot bar 34 therein. Another end of the bore is circular in cross section and defines a stop 44 against which the pivot bar 34 abuts. Adjacent the stop, a bottom wall is recessed to define a lip 46.

The bottom of the housing 32 is provided with a flange 48 or pair of flanges spaced above the body 36 and defining a pair of walls 50. The flange 48 and body 36 define a generally I-shaped cross section. The bottom of the body 36 has sloped walls 52. The walls 50, 52 define channels 54 that are wider toward the center of the body. A retaining detent 56 projects from the top of the body near one end.

Figure 2:
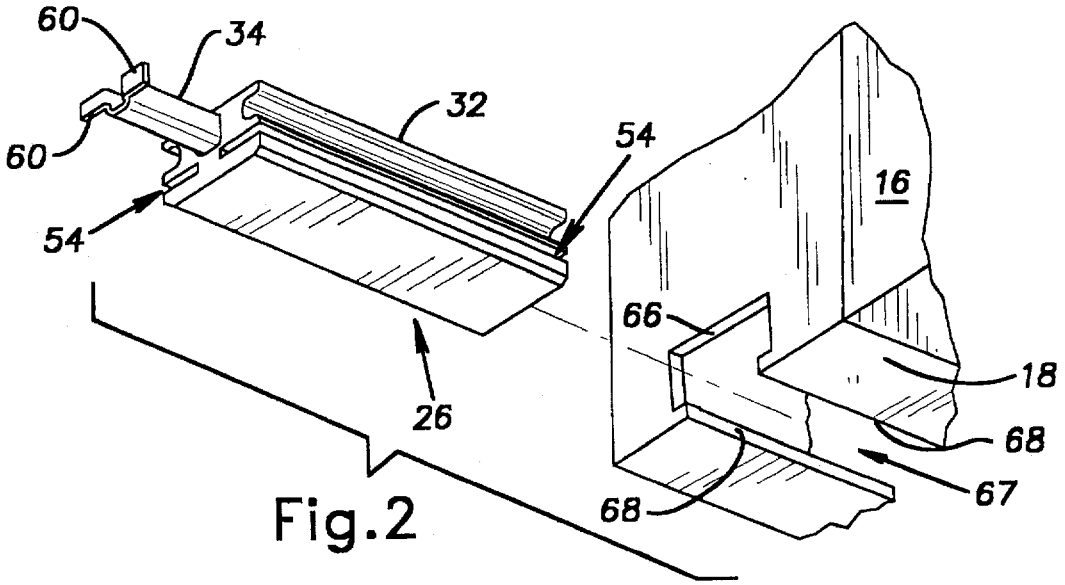
FIG. 2 shows an exploded perspective view of a lower corner of a sash and a pivot assembly.
Figure 3:
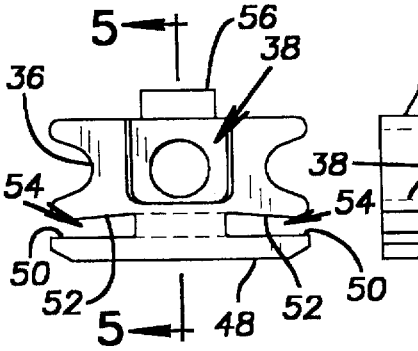
FIG. 3 shows an end view of the pivot assembly.
Figure 4:
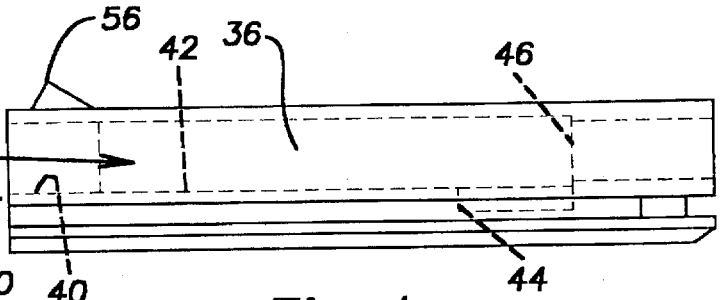
FIG. 4 shows a side view of the pivot assembly.
Figure 5:
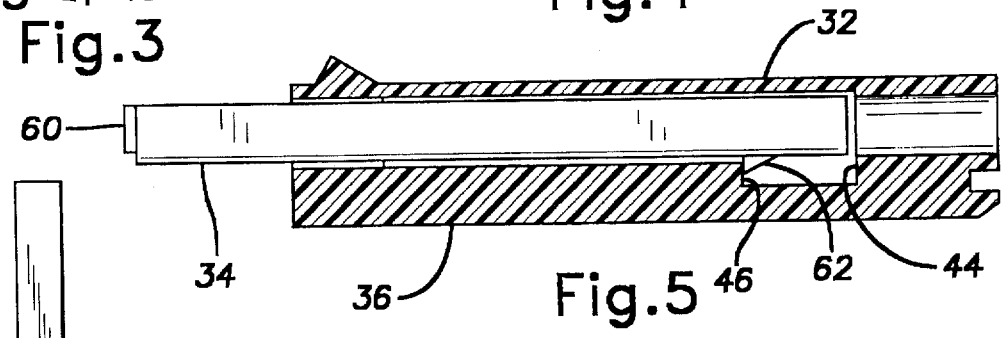
FIG. 5 shows a sectional side view of the pivot assembly taken from line 5—5 of FIG. 3.

Referring to FIGS. 2 and 5, the pivot bar 34 has a U-shaped cross section of formed metal. One end of the pivot bar is provided with laterally extending flanges 60. A detent 62 projects from a bottom wall of the pivot bar near another end. The pivot bar 34 is located within the bore 38 of the housing 32 so that the pivot bar detent 62 engages behind the lip 46 to prevent longitudinal movement of the pivot bar in one direction, as shown in FIG. 5. An end of the pivot bar 34 engages the stop 44 to prevent longitudinal movement of the pivot bar in another direction. The pivot bar projects from the housing 32 so that the flanges are spaced from the housing.

Figure 8:
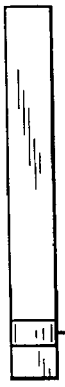
FIG. 8 shows a top view of the pivot bar.
Figure 7:
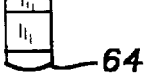
FIG. 7 shows an end view of the pivot bar.
Figure 6:
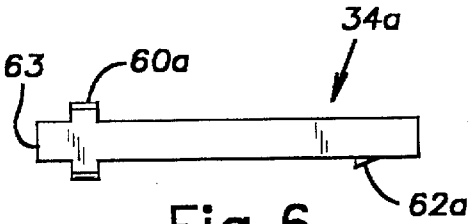
FIG. 6 shows a side view of a pivot bar.
Figure 9:
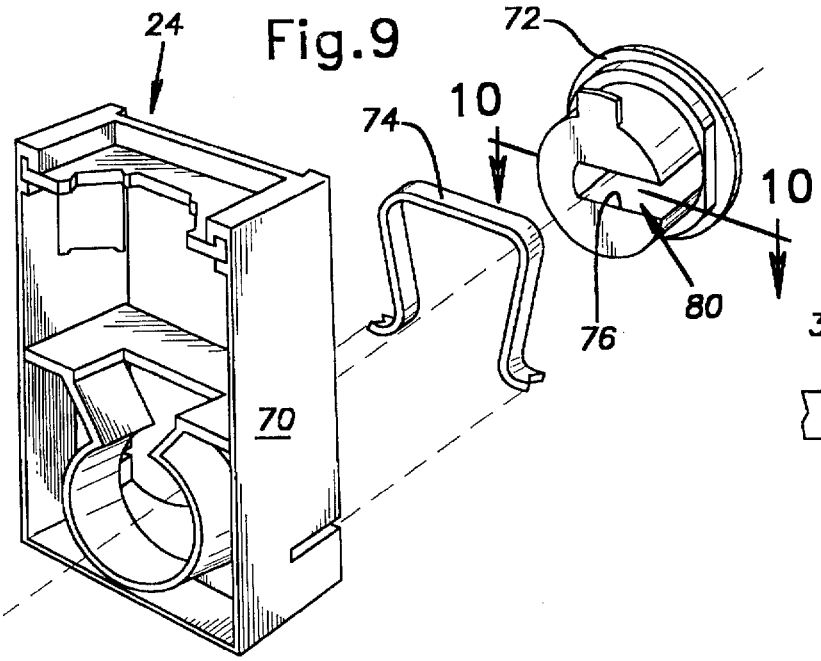
FIG. 9 shows an exploded perspective view of a brake assembly.

Other configurations of the pivot bar are also suitable. For example, referring to FIGS. 6–8, the pivot bar **34*a* can be cast as a bar having a rectangular cross section with rounded corners. The Flanges 60*a* extend from long edges of the bar and have ends 64 defining segments of a single circle. The flanges 60*a* can be set back from the end of the bar to define a longitudinally projecting nose 63. The detent 62*a* projects from one of the long edges near an end of the pivot bar 34*a*. The pivot bar 34*a* fits in the bore 38 similarly to the pivot bar 34** previously discussed. For other configurations of the pivot bar, the bore of the housing is correspondingly sized and shaped to accommodate the pivot bar.

Referring to FIG. 2, the lower end of the sash stile 16 is provided with a notch 66 or slot to allow passage of the pivot housing 32 therethrough. A second notch 67 or slot is cut in a lower wall of the lower rail 18 to define a pair of opposed tracks 68 or rails. The second notch 67 is as long as the housing 32. The pivot housing 32 is installed in the notch 66 so that the tracks 68 are received in the channels 54. The detent 56 (FIG. 4) engages behind an outer wall of the stile 16 immediately above the notch 66 to retain the housing 32 in place.

As a result of forming and welding the sash 12 and cutting the notches 66, 67, the tracks 68 have inconsistent thickness along their length and are deformed somewhat at their edges. The width of the channels 54 at their openings is such that the tracks snugly fit therein. The sloped walls 52 provide a larger space to accommodate the deformations and inconsistent thickness of the track edges. The channels 54 are deep enough that the walls 50 of the flange 48 are somewhat flexible for accommodating the deformations and inconsistent thickness of the track edges.

Figure 10:
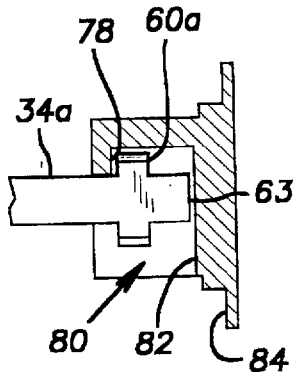
FIG. 10 shows a sectional view of a cam taken from line 10—10 of FIG. 9.

Referring to FIGS. 9–12, the brake assembly 24 includes a housing 70, a cam 72, and a movable or deformable brake 74, such as a shoe or spring. The cam 72 has a central passage 76 provided with a lip 78 (FIG. 10) and a lateral opening 80. The passage 76 has a height slightly greater than the thickness of the pivot bar **34*a* permitting insertion of the pivot bar therein, as shown in FIG. 10. The pivot bar 34, 34*a* and central passage 76 are eccentric so that they mate, thereby limiting rotation of the pivot bar relative to the cam. The lip 78 is spaced from an internal back wall 82 such that one of the flanges 60*a* is received behind the lip. The back wall 82 limits longitudinal travel of the pivot bar 34*a* in one direction by engaging the nose 63 and the lip 78 limits longitudinal travel of the pivot bar 34*a* in another direction by engaging the flange 60*a*. A flange 84 is provided on the cam 72 for retaining the cam in the housing 70**.

Figure 11:
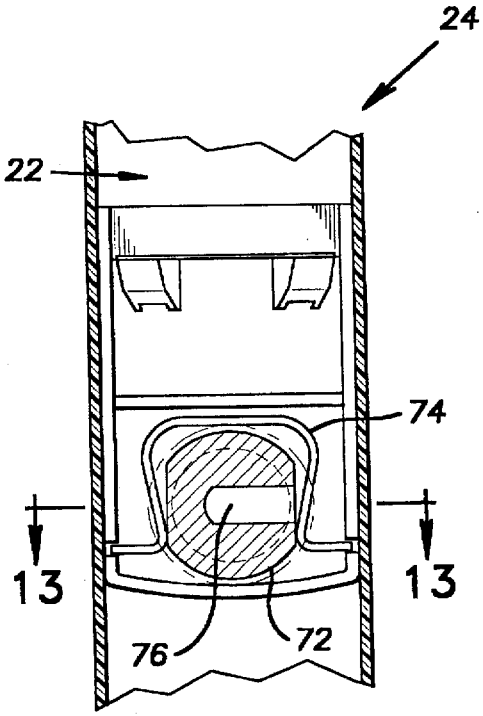
FIG. 11 shows an elevational view of brake assembly installed in a window frame.
Figure 12:
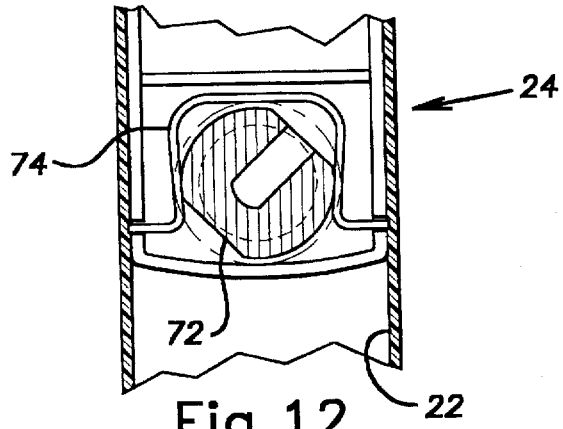
FIG. 12 shows the elevational view of FIG. 11 in a locked position.
Figure 13:
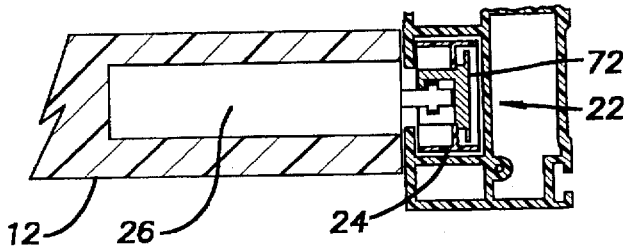
FIG. 13 shows a top sectional view of the window frame taken from line 13—13 of FIG. 11.

Referring to FIGS. 11–13, the cam 72 and brake 74 are installed in the housing. The housing is slidably disposed in the slide channel 22. Rotation of the cam 72 with the pivot assembly causes outward movement or expansion of the brake 74, as shown in FIG. 12. The brake engages walls of the slide channel 22 to prevent movement of the brake assembly 24. Thus, when the window sash 12 is tilted as shown in FIG. 1, the pivot and brake assembly 24, 26 locks the sash in place. When the sash is in the vertical position, as shown for the upper sash 11, the brake is in the nonlocking retracted position of FIG. 11 and the sash is vertically slidable. Numerous variations of such brake assemblies are suitable, examples of which have been previously cited above.

The present disclosure describes several embodiments of the invention, however, the invention is not limited to these embodiments. Other variations are contemplated to be within the spirit and scope of the invention and appended claims.

What is claimed is:

1. A pivot assembly for a window assembly having a window sash with a notch defining a pair of opposed tracks and having a brake assembly slidably disposed in a frame of the window assembly, the pivot assembly comprising:

a rigid body having walls;

a pivot bar projecting from the body and having an end adapted for being received in the brake assembly; and a flange extending from the body to distal edges of the flange and having walls spaced from walls of the body so as to define a pair of opposed channels, bases of the channels being defined where the flange is attached to the body, the assembly being slidable into the window sash and the channels being adapted for receiving the opposed tracks of the window sash therein, the channels being narrower at the distal edges than at the bases for accommodating deformations and thickness variations of edges of the tracks received in the windows.

2. A pivot assembly according to claim 1, wherein the flange and body define a generally I-shaped cross section.

3. A pivot assembly according to claim 1, wherein the flange walls are sufficiently flexible to permit movement of the walls for accommodating deformations and thickness variations of edges of the track received in the channels.

4. A pivot assembly according to claim 1, wherein the walls of the body are sloped from the distal edges of the flange to the bases of the channels for accommodating deformations and thickness variations of edges of the track received in the channels.

5. A pivot assembly according to claim 1, wherein the body includes a longitudinal bore receiving the pivot bar therein, wherein the bore is stepped so as to define a lip and a stop, the pivot bar is provided with a detent engaging the lip, and an end of the pivot bar engages against the stop to limit longitudinal movement of the pivot bar and retain the pivot bar in the body.

6. A pivot assembly according to claim 1, further comprising a detent projecting from the body and adapted for engaging a wall of the window sash for retaining the pivot assembly therein.

7. A pivot and brake assembly for a window assembly comprising:

a brake assembly having a housing for being slidably disposed in a frame of the window assembly; a brake movable to engage the frame so as to resist movement of the housing in the frame; a cam disposed in the housing and rotatable for moving the brake; and a pivot assembly having a rigid body having walls; a pivot bar projecting from the body and having an end received in the cam so that pivoting of the pivot bar rotates the cam; and a flange extending from the body to distal edges of the flange and having walls spaced from walls of the body for defining a pair of opposed channels, bases of the channels being defined where the flange is attached to the body, the assembly being slidable into a notched window sash of the window assembly and the channels being adapted for receiving opposed tracks of the window sash therein, the channels being narrower at the distal edges than at the bases for accommodating deformations and thickness variations of edges of the tracks received in the windows.

8. A pivot assembly according to claim 7, wherein the cam includes a central passage in which the pivot bar is received, the bore having a lip therein, and the pivot bar includes a flange projecting from the pivot bar and engaging the lip to limit longitudinal movement of the pivot bar and retain the pivot bar in the cam.

9. A pivot assembly according to claim 8, wherein the flange is spaced from an end of the pivot bar to define a nose and the cam is provided with a back wall for engaging the nose to limit longitudinal movement of the pivot bar and retain the pivot bar in the cam.

10. A pivot assembly according to claim 7, wherein the pivot bar is eccentric and the cam includes an eccentric passage in which the pivot bar is received, the bar and passage mating so as to limit rotation of the bar relative to the cam.

11. A window assembly comprising:

a frame having two spaced, opposing, generally parallel slide channels;

a sash having two spaced, generally parallel stiles and spaced, generally parallel header and footer rails assembled to form a generally rectangular shape, wherein each of said stiles is adapted for sliding along a corresponding one of the slide channels, and said footer rail having a hollow construction and a notch at each end thereof, each notch defining a pair of opposed, generally parallel tracks;

a pair of brake assemblies each comprising a housing slidably disposed in the respective slide channel; a brake movable to engage the slide channel so as to resist movement of the housing in the slide channel; a cam disposed in the housing and rotatable for moving the brake;

a pair of pivot assemblies each having a rigid body having walls; a pivot bar projecting from the body and having an end received in the respective cam so that pivoting of the pivot bar rotates the cam; and a flange extending from the body to distal edges of the flange and having walls spaced from walls of the body for defining a pair of opposed channels, bases of the channels being defined where the flange is attached to the body, the assembly being slidable into the notch of the sash and the channels receiving opposed tracks of the respective window sash notch therein the channels being narrower at the distal edges than at the bases for accommodating deformations and thickness variations of edges of the tracks received in the windows; and a counterbalance disposed in each of the slide channels and attached to the corresponding brake assembly.

12. A pivot assembly according to claim 11, wherein the walls of the body are sloped from the distal edges of the flange to the bases of the channels for accommodating deformations and thickness variations of edges of the track received in the channels.

13. A pivot assembly according to claim 12, wherein the body is includes a longitudinal bore receiving the pivot bar therein wherein the bore is stepped so as to define a lip and a stop, and the pivot bar is provided with a detent engaging the lip an end of the pivot bar engages against the stop to limit longitudinal movement of the pivot bar and retain the pivot bar in the body.

14. A pivot assembly according to claim 13, further comprising a detent projecting from the body and adapted for engaging a wall of the window sash for retaining the pivot assembly therein.

* * * * *

UNITED STATES PATENT AND TRADEMARK OFFICE

CERTIFICATE OF CORRECTION

PATENT NO. : 5,669,180
DATED : September 23, 1997
INVENTOR(S) : Robert G. Maier

It is certified that error appears in the above-identified patent and that said Letters Patent is hereby corrected as shown below:

On the title page the following information should be inserted with respect to the assignee: --Ro-Mai Industries, Inc, Twinsburg, Ohio--.

Signed and Sealed this

Twenty-eighth Day of July, 1998

Bruce Lehman

*Attest:*

BRUCE LEHMAN

*Attesting Officer*

*Commissioner of Patents and Trademarks*